US005214357A

United States Patent [19]

Dakin et al.

[11] Patent Number: 5,214,357

[45] Date of Patent: May 25, 1993

[54] LOW-LOSS L-C DRIVE CIRCUIT FOR AN ELECTRODELESS HIGH INTENSITY DISCHARGE LAMP

[75] Inventors: James T. Dakin; Mark E. Duffy, both of Shaker Heights; Raymond A. Heindl, Euclid; Victor A. Levand, Jr., Lyndhurst, all of Ohio

[73] Assignee: General Electric Company, Schenectady, N.Y.

[21] Appl. No.: 792,114

[22] Filed: Nov. 14, 1991

[51] Int. Cl.[5] ..... H05B 41/16

[52] U.S. Cl. ..... 315/248; 315/344

[58] Field of Search ..... 315/248, 344, 39, 267; 313/234, 635, 607

[56] References Cited

U.S. PATENT DOCUMENTS

| | | | |
|---|---|---|---|
| 4,910,439 | 3/1990 | El-Hamamsy | 315/248 |
| 5,039,903 | 8/1991 | Farrall | 315/248 |
| 5,042,139 | 8/1991 | Farrall | 315/248 |
| 5,047,692 | 9/1991 | Borowiec | 315/248 |
| 5,057,750 | 10/1991 | Farrall | 315/248 |
| 5,075,600 | 12/1991 | El-Hamamsy | 315/248 |

*Primary Examiner*—Eugene R. LaRoche
*Assistant Examiner*—A. Zarabian
*Attorney, Agent, or Firm*—George E. Hawranko; Stan Corwin

[57] ABSTRACT

A low-loss L-C circuit arrangement for an electrodeless high intensity discharge (HID) lamp includes an excitation coil having at least one coil turn which is disposed in surrounding relation to the arc tube portion of the HID lamp and is configured in a low profile manner so as to minimize light blockage caused thereby. The L-C circuit arrangement includes a capacitor member having first and second capacitor plates which are electrically and mechanically connected to the excitation coil. The connection between the excitation coil and the capacitor member is made by a pair of connection members integrally formed with the coil turn and capacitor plates from a stock sheet of electrically and thermally conductive material.

13 Claims, 4 Drawing Sheets

LOW-LOSS L-C DRIVE CIRCUIT FOR AN ELECTRODELESS HIGH INTENSITY DISCHARGE LAMP

FIELD OF THE INVENTION

This invention relates to a drive circuit electrodeless high intensity discharge lamp. More particularly, this invention relates to such a drive circuit as utilizes a low loss inductive-capacitive arrangement to produce a high frequency drive current and wherein the inductor and capacitor elements are formed of sheet metal.

BACKGROUND OF THE INVENTION

A significant effort has recently been directed to the task of maximizing the overall performance characteristics of discharge lamps. Such an effort has been notable in the area of electrodeless high intensity discharge (HID) lamps which operate using a high pressure gas fill and an inductively coupled high frequency RF current to create the arc discharge. An example of such an electrodeless HID lamp can be found in U.S. Pat. No. 4,810,938 issued to P. D. Johnson et al on Mar. 7, 1989 and assigned to the same assignee as the present invention, such patent being hereby incorporated by reference. In this patent, an electrodeless HID lamp is inductively driven by a high frequency RF current source which produces an arc discharge within an arc tube containing a gas fill comprising a combination of sodium halide and cerium halide along with xenon gas in proper weight proportions to generate a white color lamp emission exhibiting improved efficacy and color rendering properties.

In order to produce the arc discharge within the arc tube, an electrodeless HID lamp must either capacitively or inductively couple a high frequency RF current to the gas fill of the arc tube. Such a high frequency RF current can be produced by a ballast circuit such as described in U.S. Pat. No. 4,812,702 issued to J. M. Anderson on Mar. 14, 1989 and assigned to the same assignee as the present invention, U.S. Pat. No. 4,812,702 being hereby incorporated by reference. In this patent, an excitation coil is disposed in surrounding relation to the arc tube so that inductively coupled high frequency RF current flowing in such excitation coil results in a time-varying magnetic field which in turn, produces an electric field within the arc tube that substantially closes upon itself. As a result of this solenoidal electric field produced within the arc tube, a toroidally shaped arc discharge is produced in the fill. The excitation coil of this patent is formed having a plurality of turns arranged upon the surface of a torus in a generally V-shaped cross-sectional manner. A tapped reactance impedance matching arrangement is also coupled to the excitation coil. Though this ballast arrangement for an electrodeless HID lamp has proven effective for producing the toroidally shaped discharge within the arc tube, the construction of the excitation coil is costly to implement on a mass production basis and moreover, such V-shaped multiple turn arrangement has the further disadvantage that a substantial portion of the light output from the arc discharge is blocked by the coil structure.

One approach to alleviating the problem of a costly and complex coil construction which can block the light output of the arc discharge is illustrated in U.S. Pat. No. 5,039,903 which issued to G. A. Farrall on Aug. 13, 1991 and is assigned to the same assignee as the present invention, this patent hereby being incorporated by reference. The coil configuration of the Farrall patent minimizes the problem of the excitation coil blocking light output by providing a reduced profile excitation coil. The excitation coil of the Farrall patent comprises one or more coil turns connected in series. The shape of each turn is generally formed by rotating a bilaterally symmetric trapezoid about a coil center line situated in the same plane as the trapezoid, but which line does not intersect the trapezoid, and providing a crossover means for achieving the series connection of the turns. Though this approach has provided an advantage over previous designs in terms of avoiding light blockage by the excitation coil, this approach can be costly to implement on a commercial basis because of the requirement that the coil use a high conductivity copper with an associated investment casting process that can also be costly. In addition, such approach requires the use of a number of braze joints to series connect the two individual turns together and also to connect the other ends of the coil turns to capacitive elements that are necessary to develop the resonant frequency for driving the arc discharge. Of further consideration in terms of applying this approach for commercial mass production purposes is the fact that the thermal management properties of this device require a significant cost and manufacturing time expenditure as well. One example of a thermal management technique discussed in this patent is the use of a liquid cooling channel formed within the coil turns, such an approach having an obvious cost disadvantage. Therefore, it would be advantageous to provide an L-C circuit arrangement for an electrodeless high intensity discharge lamp which would exhibit low energy loss properties and would be operable by means of a high frequency RF current and further, where such L-C circuit were constructed in a manner that would lend itself to mass production manufacturing techniques and would utilize materials and thermal management techniques that would not unduly increase the overall cost of the lamp end product.

SUMMARY OF THE INVENTION

The present invention provides a drive circuit arrangement for an electrodeless high intensity discharge (HID) lamp which is particularly suited to mass production manufacturing processes and for which such processes can be implemented using materials and techniques which are cost efficient and yet, deliver the necessary high frequency power without experiencing energy losses that could otherwise adversely affect the operation of the electrodeless HID lamp. Operation of the drive circuit arrangement is accomplished with a minimum amount of light blockage resulting from the disposition of the circuit's inductive component in surrounding relation to a portion of the arc tube of the electrodeless high intensity discharge lamp. Moreover, the drive circuit configuration of the present invention allows for the use of a heat sink arrangement which can be simply and economically adapted to the capacitive component and yet achieve the necessary thermal management properties to accommodate the total drive circuit arrangement. In accordance with the principles of the present invention, there is provided a drive circuit arrangement for an electrodeless HID lamp which includes an arc tube and a gas fill disposed therein and further, wherein such gas fill is excited to an arc discharge state when a high frequency RF current generated by the drive circuit is coupled thereto. The drive circuit arrangement includes an excitation coil disposed in surrounding relation to the arc tube; the excitation coil includes one or more coil turns which are constructed so as to have a reduced height relative to a corresponding size associated with the arc tube. The drive circuit arrangement further includes a capacitive element having a first and a second capacitive plate which are electrically and mechanically connected to the coil turns of the excitation coil by means of a connecting member which is integrally formed between the capacitive plates and the coil turns. In order to drive the circuit arrangement of the present invention such that the proper operating frequency is achieved for exciting the arc discharge, a high frequency power source is connected to the capacitive plates.

BRIEF DESCRIPTION OF THE DRAWINGS

In the following detailed description, reference will be made to the attached drawings in which.

DETAILED DESCRIPTION OF THE INVENTION

Figure 1:
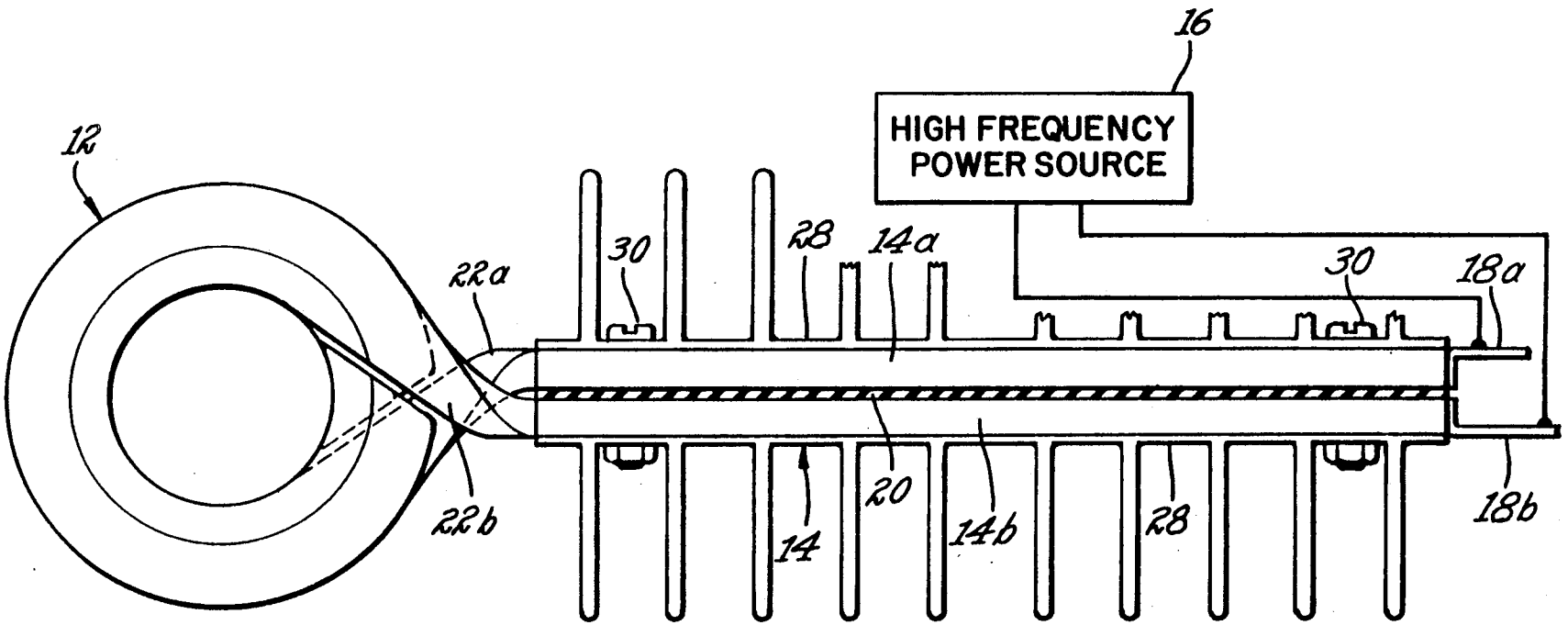
FIG. 1 is an elevational view in section of a drive circuit arrangement for an electrodeless HID lamp constructed in accordance with the present invention.
Figure 2:
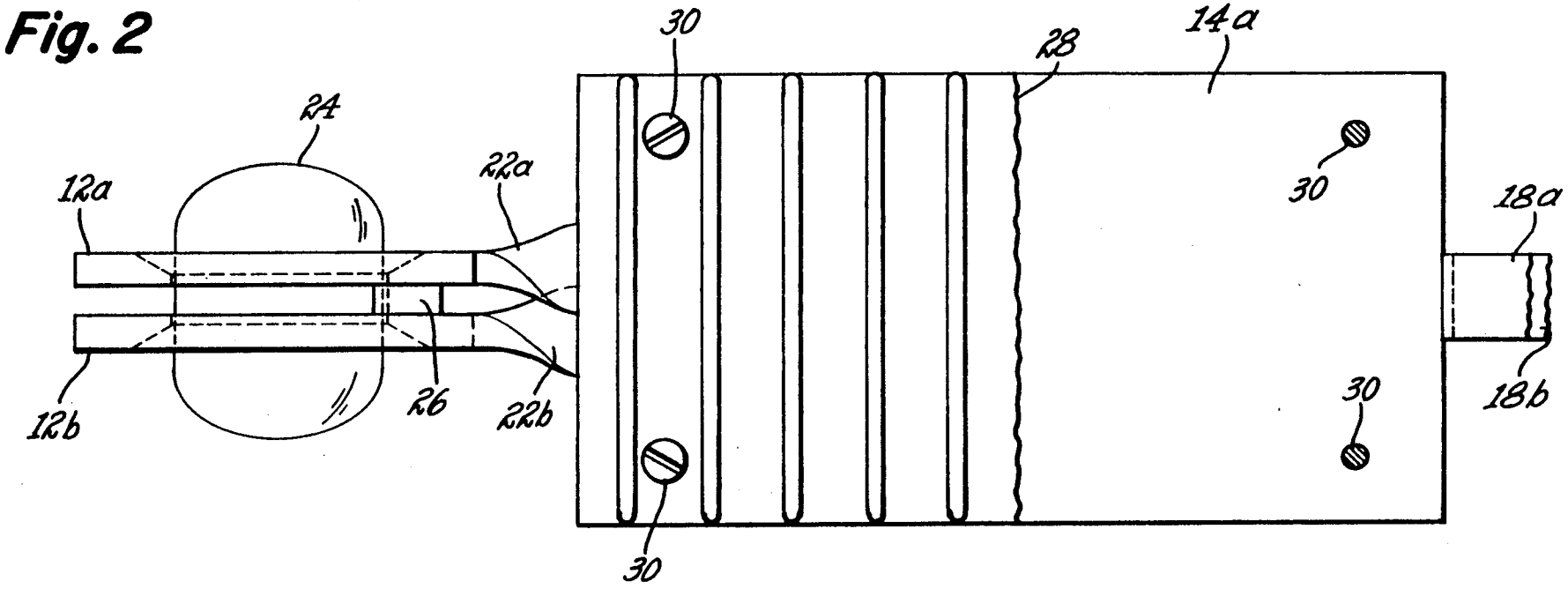
FIG. 2 is an elevational view taken along lines I—I of FIG. 1 of a drive circuit arrangement constructed in accordance with the present invention.

As seen in FIG. 1, the circuit arrangement 10 for an electrodeless high intensity discharge (HID) lamp (not shown) of the present invention includes an inductive portion 12, a capacitive portion 14, and a high frequency power source 16 shown in block diagram form. Circuit arrangement 10 is effective for developing a high frequency RF current which, when inductively coupled to the electrodeless HID lamp, generates an arc discharge within an arc tube portion 24 (FIG. 2) of the electrodeless HID lamp. As discussed in the aforementioned U.S. Pat. No. 4,810,938, the arc tube may be of a generally ellipsoidal shape and may be filled with a suitable fill which includes a sodium halide, a cerium halide and xenon. This fill is excited to an arc discharge state having a generally toroidal shape by means of the induced current flowing through the arc tube. The RF current generated by circuit arrangement 10 of the present invention results in a time-varying magnetic field which produces within the arc tube, a solenoidal electric field that substantially closes upon itself thereby causing such current flow within the arc tube that results in the occurrence of the toroidally shaped arc discharge.

The electrodeless HID lamp for which the present circuit arrangement 10 provides the appropriate inductively coupled drive current, can operate within the frequency range of between 0.1 and 300 megahertz (MHz), with an exemplary operating frequency being 3.56 MHz. Excitation coil 12 and capacitor member 14 are constructed to form a tank circuit which resonates near this drive frequency. An important design consideration in the operation of circuit arrangement 10 is that such circuit not experience or cause significant energy losses that could affect the operation of the electrodeless HID lamp. In order to minimize energy losses in this tank circuit, it is necessary that the tank circuit components, the excitation coil 12 and the capacitor member 14 be constructed of a material that is a good electrical and thermal conductor; such a material would reduce ohmic heating and expedite thermal conduction from the heat sources to the heat sinks.

In order to achieve the above-noted operating frequency, the circuit arrangement 10 must have as an input thereto, a high frequency power signal such as can be provided by power source 16 illustrated in FIG. 1 in block diagram form. The high frequency power source 16 provides a suitable tuned source of high frequency power to the circuit arrangement 10 and typically provides this necessary power by converting a standard line current of either 50 or 60 hz frequency into the appropriate drive signal strength and frequency. A conventional high frequency power supply having a sinusoidal waveform output can be coupled over a suitable impedance matching network to the circuit arrangement 10. As an example of an alternate high frequency power source, reference is hereby made to U.S. Pat. No. 5,047,692 issued to Borowiec et al on Sep. 10, 1991 and assigned to the same assignee as the present invention; this patent being hereby incorporated by reference. In this patent, the high frequency power source can include a driver arrangement in a high efficiency Class D power amplifier configuration. Such a power source configuration utilizes switching devices such as MOSFETs to provide a high frequency square wave input to circuit arrangement 10. The tank circuit arrangement 10 will utilize the high frequency waveform and generate therefrom the necessary frequency sinusoidal current signal in the inductor 12 which induces the arc discharge within the arc tube. The power source 16 is connected to leads 18 which are fixedly secured to one end of the capacitor member 14. As illustrated in FIG. 1, leads 18 include a first and a second lead **18*a* and 18*b* which are connected respectively to first and second capacitor plate elements 14*a* and 14*b* associated with the capacitor member 14. It is also possible to connect the power source 16 to the capacitor 14 without the use of leads 18. For example, one of the capacitor plates 14*a*, 14*b* can be grounded and the other plate 14*a*, 14*b*** can have positive energy connected thereto by means of a conducting rod which could in fact pass through an insulative bushing disposed in the grounded capacitor plate. It is intended that such an alternate connecting arrangement is within the scope of the present invention.

As previously noted, the capacitor plates **14*a* and 14*b* will be formed of a material having good electrical and thermal conduction properties. As an example, the capacitor plates 14*a* and 14*b* can be formed of sheet stock of copper. Alternatively, the capacitor plates 14*a* and 14*b* can be formed of aluminum or any other suitable metal having high thermal and electrical conductivity properties. In forming the capacitor plates 14*a* and 14*b*, the dimensions, as can be more clearly seen in FIG. 2, will be of a substantial cross-sectional area thereby minimizing the thermal impedance properties of the capacitor member 14. Additionally, in the manufacturing process in which the capacitor plates 14*a* and 14*b* are formed, a finishing step is utilized to smooth the edges thereof and thus provide a measure for minimizing high edge fields which could otherwise damage any dielectric material associated with capacitor member 14. A suitable dielectric material 20 is disposed between capacitor plates 14***a* and 14*b* to achieve the appropriate capacitive value for the capacitor member 14. An example of a suitable dielectric material is teflon, which, for the present invention provides for an exemplary capacitive value of 700 picofarads. A suitable inductive value for excitation coil 12 is 140 nanohenrys. Of course it can be understood that different dielectric materials can be used which can then result in different capacitive values and alternate inductive values can be provided in order to achieve the necessary operating frequency within the previously stated range of 0.1 to 300 MHz.

Figure 3:
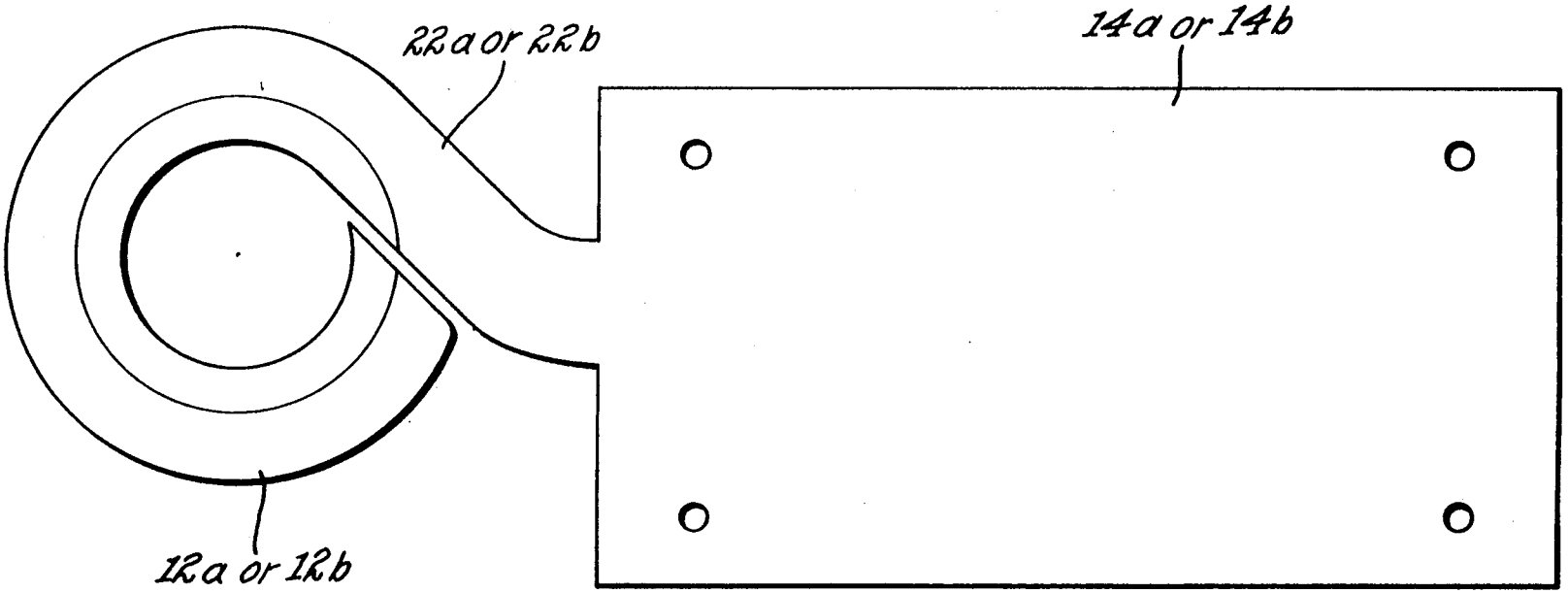
FIG. 3 is an elevational view of a portion of the circuit arrangement of the present invention prior to assembly.

Connected at the opposite ends of the capacitor plates 14*a* and 14*b* as the leads 18*a* and 18*b*, is a pair of connecting members 22*a* and 22*b*. The connecting members 22*a* and 22*b* are in essence, nothing more than a continuation of the sheet stock of copper from which the capacitor plates 14*a* and 14*b* were formed. As seen in FIG. 3, the circuit arrangement 10 can be provided by like components of one capacitor plate and one coil turn shown here in unfinished and unassembled form. In the production process of forming the capacitor 14 and excitation coil 12, these respective components can be simultaneously formed using conventional punch press techniques and wherein such punch press techniques yield the unfinished copper stock product that comprises one plate 14*a* or 14*b* of capacitor 14, one turn 12*a* or 12*b* of excitation coil 12 and one connection portion 22*a* or 22*b* formed between the capacitor member 14 and excitation coil 12 as shown in FIG. 3. As illustrated in FIGS. 1 and 3, connecting members 22*a* and 22*b* are thus contiguously joined to the excitation coil 12 such that the excitation coil 12 and the capacitor member 14 are electrically and mechanically connected to one another by the connecting members 22*a* and 22*b*. The excitation coil 12 as more clearly illustrated in FIG. 2 includes a first and a second coil turn 12*a* and 12*b* which are connected respectively to the first and second capacitor plates 14*a* and 14*b* as previously described. For a description of the configuration of the two coil turns that make up the excitation coil 12, reference is hereby made to previously cited U.S. Pat. No. 5,039,903 issued to G. A. Farrall. In this patent, it is disclosed that the excitation coil comprises one or more coil turns which are connected in series. The shape of each coil turn is configured so as to result in as small an amount of light blockage out of the arc tube as possible. Each turn is formed by rotating a bilaterally symmetric trapezoid about a coil center line situated in the same plane as the trapezoid, but which line does not intersect the trapezoid. Additionally, a crossover braze connection 26 is further provided for connecting the two coil turns as illustrated in the present figure. Of course, it is possible to allow for series connecting the coil turns 12*a* and 12*b* without the use of a separate bronze member 26. For instance, a projection can be formed on one of the coil turns which can then be coupled to the other coil turn. It is further illustrated in FIG. 1 that the excitation coil 12 is disposed in an angularly oriented manner relative to the horizontal plane in which the capacitor plates 14*a* and 14*b* reside, this orientation is approximately a 90° angle and is provided so as to minimize induced circulating currents in the capacitor plates 14*a* and 14*b*. The procedure for thus orienting the coil turns 12*a* or 12*b* relative to the capacitor plates 14*a* or 14*b* can be simply carried out using conventional bending techniques. Additionally, the previously discussed procedure for finishing the edges of the structure punched from the sheet stock to form a capacitor plate, coil turn and connection member, will also provide for finishing the coil turn to the switchable cross-sectional configuration shown in dashed line format in FIG. 2. Once a pair of punched, finished and bent structures comprising the capacitor plate, coil turn and connecting portion have been completed, the tank circuit arrangement 10 can be constructed by disposing the dielectric material 20 therebetween. Additionally, a single brazing operation is needed to connect the two coil turns 12*a* and 12*b* by means of the crossover braze connection 26 and further, leads 18*a* and 18*b* or some alternate connecting arrangement can be connected to the capacitor plates 14*a* and 14*b* to allow for connection to the high frequency power source 16.

As seen in FIG. 1, a heat sink plate 28 having outwardly extending fins formed thereon, is disposed in a contacting manner against the outer face of capacitor plates 14*a* and 14*b*. The heat sinks 28 can be constructed from extruded aluminum and can be secured to the capacitor plates 14*a* and 14*b* by insulating bolts 30 so that the heat sink plates maintain a good thermal contact with the capacitor plates 14*a*, 14*b* thus achieving good heat dissipation for the entire tank circuit arrangement 10. Insulative bolts 30 serve the additional purpose of clamping the capacitor member 14 assembly. Additionally, bolts 30 are effective for maintaining a fixed spacing between capacitor plates 14*a* and 14*b* thus insuring a constant capacitive value for capacitor member 14. Although illustrated in a manner such that the heat sink plates 28 contact the entire outer surface of capacitor plates 14*a*, 14*b*, a smaller area can be covered and still achieve acceptable thermal management results. In the illustrated embodiment, we have found that heat sink plates 28 are effective for dissipating heat for the entire tank circuit arrangement 10 even without directly contacting the excitation coil 12. As such, thermal management of the excitation coil 12 is achieved without adding structure that could further aggravate the light blockage situation or could further add to the costs of producing the circuit arrangement 10.

Figure 4:
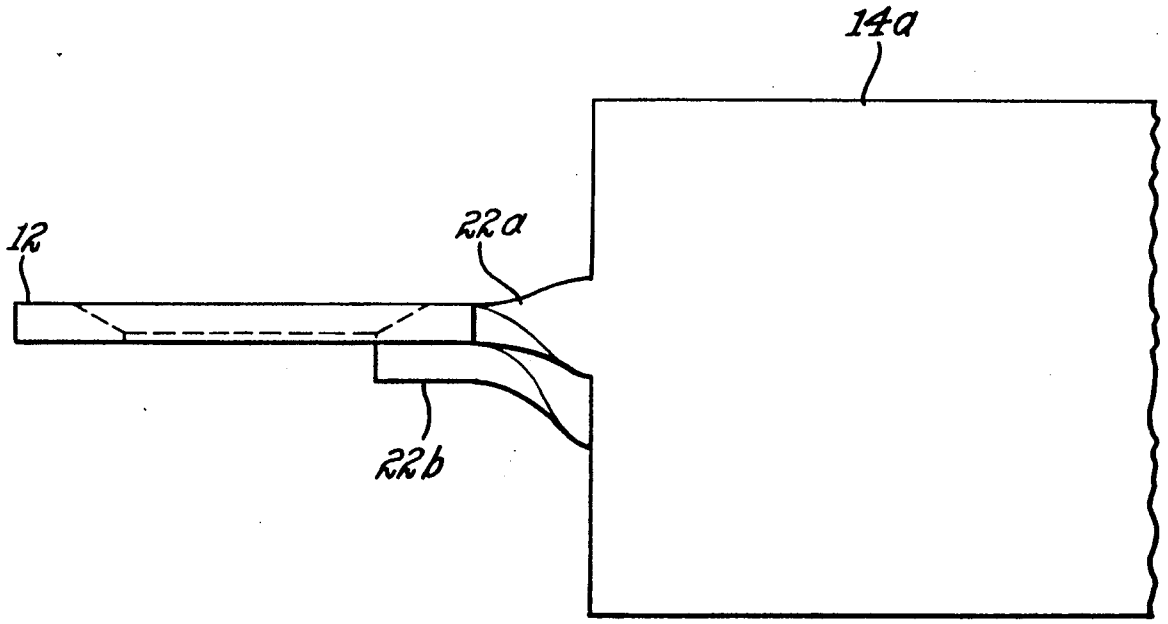
FIG. 4 is an elevational view partly in section of a circuit arrangement for an electrodeless HID lamp constructed in accordance with an alternate embodiment of the invention.

As seen in FIG. 4, the circuit arrangement 10 of the present invention can be achieved by means of an excitation coil 12 having a single coil turn 12*a*. Using this single coil turn approach, one capacitor plate 14*a* can be connected over connecting member 22*a* to one end of the coil circumference whereas the other capacitor plate 14*b* can be connected over connecting member 22*b* to the opposite end of the coil circumference. In order to achieve a coil circumference which exists in a single plane, a bend is formed in connecting member 22*b* to accommodate to lower positioning of capacitor plate 14*b*. By utilizing a single turn coil 12*a*, it is possible to integrally form the components of circuit arrangement 10 in a single punch process and further, it is possible to complete construction of circuit arrangement 10 without reliance upon a brazing step in the manufacturing process.

Although the hereinabove described embodiment of the invention constitutes a preferred embodiment, it should be understood that modifications can be made thereto without departing from the scope of the invention as set forth in the appended claims. For instance, although connecting members 22*a* and 22*b* are shown as having a short length in relation to the overall size of circuit arrangement 10, this dimension can be lengthened. Additionally, though shown preferably as having one or two coil turns 12*a* and 12*b*, excitation coil 12 can include additional turns as well.

We claim:

1. A circuit arrangement for an electrodeless high intensity discharge lamp which includes an arc tube with a gas fill disposed therein operable to an arc discharge state by a high frequency RF current coupled thereto, said circuit arrangement comprising:

an excitation coil disposed in surrounding relation to said arc tube, said excitation coil including at least one coil turn and wherein said at least one coil turn is constructed so as to have a height sized relative to a corresponding size of said arc tube so as to minimize light blockage by said excitation coil;

a capacitive member having a first and a second capacitive plate and being electrically and mechanically coupled to said excitation coil and wherein a single connection member provides both said electrical and mechanical connections, said connection member being integrally formed with said capacitive plates of said capacitive member and said at least one coil turn of said excitation coil;

high frequency power source means connected to said electrically connected capacitive member and excitation coil and being effective for providing operating energy to said capacitive member and excitation coil such that said high frequency RF current for driving said arc discharge can be produced thereby and wherein one of said capacitor plates, one of said at least one coil turn and one of said connection members are all formed from a single sheet of stock material.

2. A circuit arrangement as set forth in claim 1 wherein said capacitive plates are parallel connected with said at least one coil turn and further wherein said connection member is configured so that said capacitive plates are disposed at an angle relative to a center axis which intersects a plane in which said at least one coil turn is disposed.

3. A circuit arrangement as set forth in claim 1 wherein said at least one coil turn is formed in a shape of a trapezoid rotated about a central point and wherein said at least one coil turn is a first and a second coil turn which are electrically connected in series to one another.

4. A circuit arrangement as set forth in claim 3 wherein said first and second coil turns are connected by a braze member disposed therebetween.

5. A circuit arrangement as set forth in claim 1 wherein said stock material is copper.

6. A circuit arrangement as set forth in claim 1 wherein said high frequency power source is connected over lead members fixedly secured to one end of respective ones of said first and second capacitive plates and further wherein said connecting members are formed at an end of said first and second capacitive plates opposite to said one end on which said lead members are fixedly secured.

7. A circuit arrangement for an electrodeless high intensity discharge lamp having an arc tube in which a gas fill is disposed and which is operable to an arc discharge state by a high frequency RF current coupled thereto, said circuit arrangement comprising:

an excitation coil having at least one coil turn disposed in close proximity to said arc tube;

a capacitor member having a first and a second capacitive plate and a dielectric material disposed therebetween, said first and second capacitive plates being electrically connected to said at least one coil turn of said excitation coil;

wherein at least one of said first and second capacitive plates is formed contiguously with said at least one coil turns;

high frequency power source means connected to said capacitor member and excitation coil and being effective for providing operating energy to said capacitor member and said excitation coil such that said high frequency RF current for driving said arc discharge can be produced thereby and wherein one of said capacitor plates, one of said at least one coil turn and one of said connection members are all formed from a single sheet of stock material.

8. A circuit arrangement as set forth in claim 7, further comprising heat sink means disposed on at least a portion of at least one of said first and second capacitive plates.

9. A circuit arrangement as set forth in claim 8 wherein said heat sink means includes first and second heat sink plates having fins extending therefrom, said heat sink plates being secured to respective outer surfaces of said first and second capacitor plates such that said heat sink plates contact said capacitor plates in a flattened manner.

10. A circuit arrangement as set forth in claim 9 further comprising insulating bolt members for attaching said heat sink plates to said capacitor plates, said insulating bolt members further being effective for holding said capacitor plates together with said dielectric material therebetween.

11. A method of constructing a resonant circuit which includes an inductive and capacitive component and which is operable upon receipt of an operating signal for producing a high frequency RF current for driving a gas fill disposed within an arc tube of an electrodeless high intensity discharge lamp to a discharge state, said method of constructing said resonant circuit arrangement comprising the steps of:

forming an excitation coil by forming at least a one coil turn of a height sized relative to a corresponding size of said arc tube so as to minimize light blockage by the excitation coil;

forming a capacitive member by forming a first and a second capacitor plate member and disposing a dielectric material therebetween, said capacitive member forming step being conducted such that said excitation coil and said capacitive member are in electrical and mechanical connection between said at least one coil turn and said first and second capacitive plates and wherein said steps of forming said excitation coil and said capacitor member are performed simultaneously by first cutting from a single sheet stock of material, said excitation coil and said capacitor member and following said cutting step, finishing the edges of said excitation coil and capacitor member so that said edges are smooth.

12. A method of constructing a resonant circuit as set forth in claim 11 further comprising the step of turning said excitation coil relative to said capacitor member such that said excitation coil and capacitor member are disposed at an angle relative to one another.

13. A method of constructing a resonant circuit arrangement as set forth in claim 11 further comprising the step of disposing a heat sink element on at least a portion of respective said first and second capacitor plate members associated with said capacitor member.

* * * * *